US007219476B2

(12) United States Patent
Akins et al.

(10) Patent No.: US 7,219,476 B2
(45) Date of Patent: May 22, 2007

(54) ROOFING SYSTEM

(76) Inventors: Faron L. Akins, 248 Cameron Pl., #3, Asheboro, NC (US) 27203; Daron L. Akins, 3563 Homeward Trail, Franklinville, NC (US) 27248

( * ) Notice: Subject to any disclaimer, the term of this patent is extended or adjusted under 35 U.S.C. 154(b) by 106 days.

(21) Appl. No.: 10/999,002

(22) Filed: Nov. 30, 2004

(65) Prior Publication Data

US 2006/0123727 A1 Jun. 15, 2006

(51) Int. Cl.
*E04D 1/34* (2006.01)
*E04B 5/00* (2006.01)

(52) U.S. Cl. ..... 52/551; 52/DIG. 13; 52/409; 52/552; 52/746.11

(58) Field of Classification Search ..... 52/518, 52/551, 552, 746.11, 748.1, DIG. 13, 409
See application file for complete search history.

(56) References Cited

U.S. PATENT DOCUMENTS

| | | | | |
|---|---|---|---|---|
| 2,045,707 | A | 6/1936 | Hammersley | |
| 4,587,785 | A | 5/1986 | Rohner | |
| 4,617,770 | A | 10/1986 | Hickman | |
| 4,660,347 | A | 4/1987 | Resan | |
| 4,738,884 | A * | 4/1988 | Algrim et al. | 428/57 |
| 5,239,802 | A * | 8/1993 | Robinson | 52/518 |
| 5,737,881 | A | 4/1998 | Stocksieker | |
| 5,916,103 | A | 6/1999 | Roberts | |
| 6,701,685 | B2 | 3/2004 | Rippey | |
| 6,769,215 | B1 | 8/2004 | Carkner | |
| 6,774,344 | B1 | 8/2004 | Trowbridge et al. | |
| 6,794,449 | B2 | 9/2004 | Fisher | |
| 2002/0170254 | A1 | 11/2002 | Ritland et al. | |
| 2003/0051419 | A1 | 3/2003 | Suzuki | |
| 2003/0070391 | A1 | 4/2003 | Tachauer et al. | |
| 2004/0055240 | A1 | 3/2004 | Kiik et al. | |

FOREIGN PATENT DOCUMENTS

| | | |
|---|---|---|
| JP | 2001-295418 | 10/2001 |
| WO | 98/36139 | 8/1998 |

* cited by examiner

*Primary Examiner*—Jeanette E. Chapman
*Assistant Examiner*—Elizabeth A. Plummer
(74) *Attorney, Agent, or Firm*—Richard C. Litman

(57) ABSTRACT

The roofing system is a system that allows for numerous shingles to be attached to the roof of a house without using nails, releasably interlocking the shingles to each other and also attaching the shingles to the surface of the roof. The roofing system includes a single foundation layer of hook and loop fastening material affixed to the roof, and a plurality of shingles releasably attached to the foundation layer. The shingles are overlapped onto each other in rows and held both to each other and the foundation layer. The shingles may additionally laterally overlap each other to provide a greater level of resistance to the elements.

7 Claims, 4 Drawing Sheets

ROOFING SYSTEM

BACKGROUND OF THE INVENTION

1. Field of the Invention

The present invention relates to roofing systems, and particularly to a roofing system having shingles or other roof coverings attached to the roof without nails.

2. Description of the Related Art

As housing has evolved over the years, shingles have become the standard in protection of a house's roof. Shingles are generally typically laid onto roofs using thousands of nails for every one thousand square feet of coverage. This method requires that installers secure these thousands of nails to the roof, which involves an inordinate amount of effort. The use of nails also means that once a shingle is laid, it is difficult to remove it if it is damaged. Further, each nail translates into thousands of potential leaks in the roof.

Therefore, a method of affixing shingles to a roof that does away with the use of nails would save a great deal of time and potential roof damage. However, it is essential that any nailless shingle-mounting system provide a very secure way to affix the shingles to the house, because wind, inclement weather, tearing, or curling of the shingles will result in an unprotected roof.

Accordingly, there is a need for a roofing system that does not use nails, but additionally secures the shingles tightly to the roof and also to each other if necessary. Thus, a roofing system solving the aforementioned problems is desired.

SUMMARY OF THE INVENTION

The roofing system allows for numerous shingles to be attached to the roof of a house without using nails. The shingles are tightly affixed to the roof with a series of fasteners releasably interlocking the shingles to each other and also attaching the shingles to the surface of the roof.

The roofing system includes a single foundation layer of hook and loop fastening material and a plurality of shingles attached to the foundation layer. The foundation layer is attached to the roof either with an adhesive or with any other type of adherent. The foundation layer may be affixed to a water-resistant base sheet that is secured to the roof by adhesive or in any other manner. The shingles each have a roof attachment layer of hook and loop fastening material affixed to the entire bottom surface of the shingle. A first row of shingles is laid onto the foundation layer, securing the first row of shingles to the roof. On the upper portion of the top surface of each of the shingles is an overlap layer of hook and loop fastening material. The lower portion of the top surface of the shingle is, when laid, the exposed material that protects the roof, and may be made of asphalt, fiberglass or the like.

A second row of shingles is set onto the first row of shingles so that the lower portion of the roof attachment layer of each shingle in the second row secures to the overlap layer of a shingle in the first row of shingles. The upper portion of the roof attachment layer of each shingle in the second row attaches to the foundation layer, allowing the second row of shingles to affix both to the roof and to the first row of shingles. This process continues until the roof is completely covered with the shingles and only the exposed lower portions of each row is visible.

The shingles may include a lateral strip of hook and loop fastening material on the lateral edge of each shingle. When the shingles are laid next to each other, a first shingle partially overlaps the lateral edge of an adjacent shingle. The roof attachment layer of the first shingle mates with the lateral strip of hook and loop fastening material of the second shingle. Thus, the laterally adjacent shingles are releasably held to each other, providing a tighter hold to the roof.

By interlocking laterally adjacent shingles to each other and locking rows of shingles to subsequent rows, and additionally to the foundation layer, the roofing system provides a high level of resistance against wind, tearing, curling, and the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
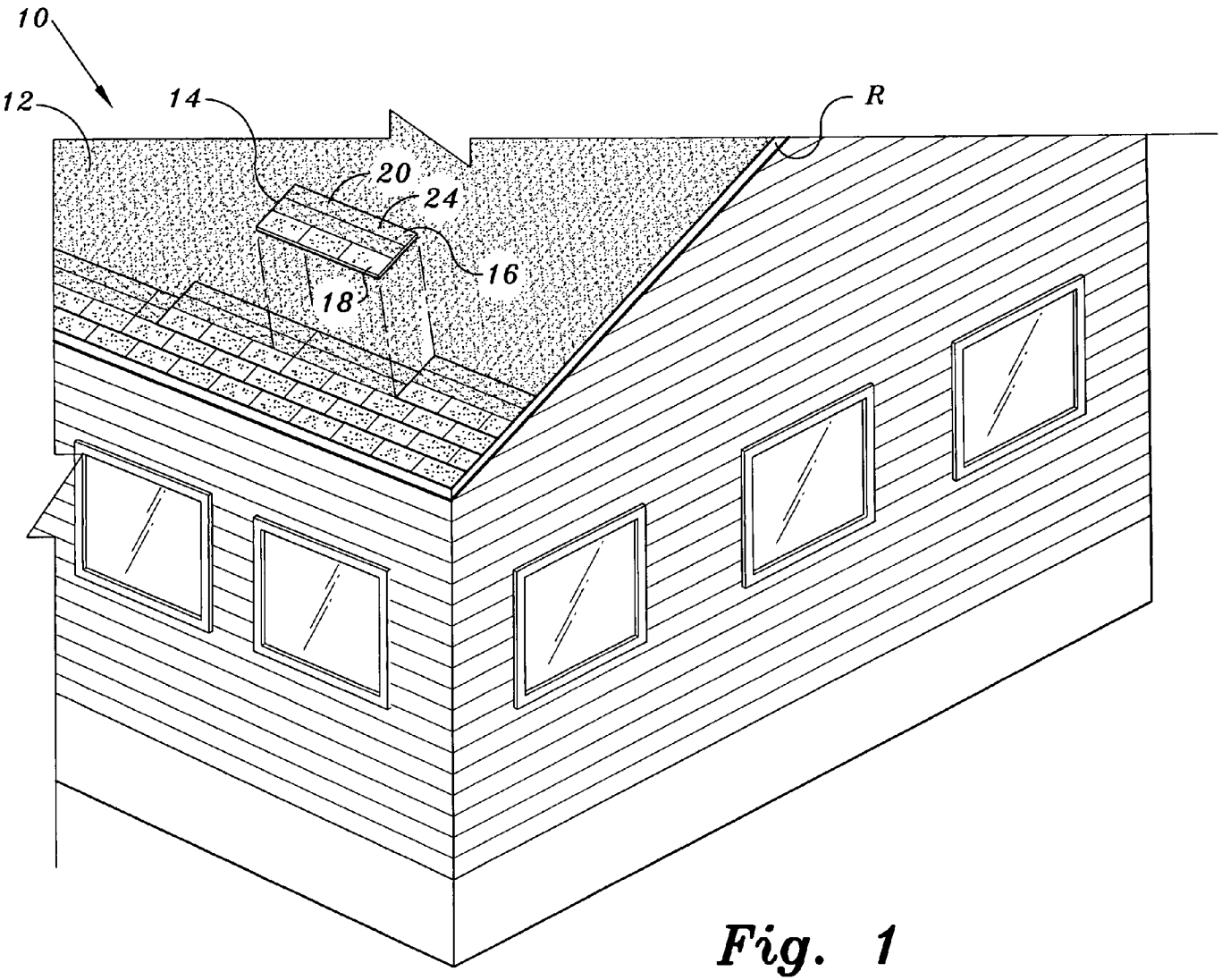
FIG. 1 is an environmental, perspective view of a roofing system according to the present invention, only a portion of the roof having shingles attached thereto to show details of the system.

The present invention is a roofing system that attaches shingles to a roof of a house without the use of nails. The roofing system, designated generally as 10 in the drawings, also interlocks the shingles to each other and to the roof surface.

FIG. 1 is an environmental, perspective view of the roofing system 10. The roofing system 10 includes a single foundation layer of hook and loop fastening material 12 and a plurality of shingles 14 attachable to the foundation layer 12. The shingles 14 are designed to interlock together in rows on a roof R, covering the entire roof R with shingles 14.

Before the shingles 14 are laid, the foundation layer 12 is affixed directly onto the roof R. The foundation layer 12 may be attached to the roof R with an adhesive, stapling or any other nailless attachment device. Once a first row of shingles 14 is affixed to the foundation layer 12, a second row of shingles 14 is placed on top of the first row so that the rows overlap each other. The rows of shingles 14 are laid in such a way that the entire roof R is eventually covered by the shingles 14.

Figure 2A:
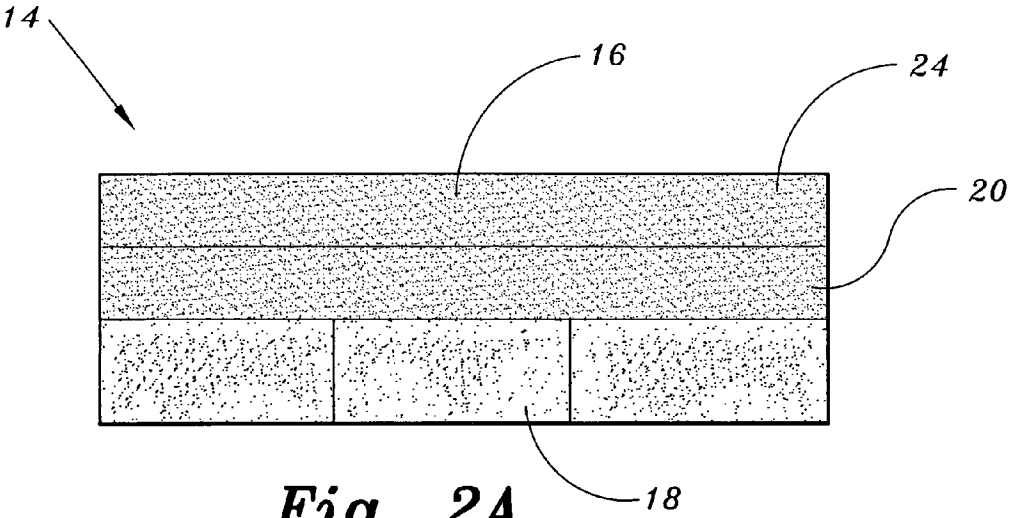
FIG. 2A is a top view of one of the shingles of the roofing system according to the present invention.
Figure 2B:
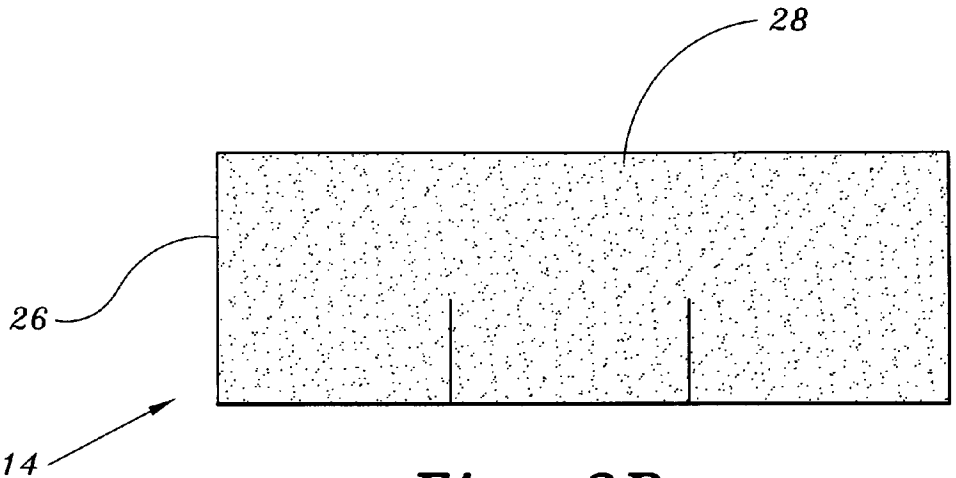
FIG. 2B is a bottom view of one of the shingles of the roofing system according to the present invention.

Turning now to FIGS. 2A and 2B, a top and a bottom view, respectively, of one of the shingles 14 is shown. FIG. 2A shows the top surface 20 of the shingle 14. The shingle 14 has an upper portion 16 and a lower portion 18. An overlap layer of hook and loop fastening material 24 is affixed to the upper portion 16 of the top surface 20 of the shingle 14. The lower portion 18 of the top surface 20 of the shingle 14 is, when laid, the exposed portion of the shingle 14. The lower portion 18 of the shingle 14 is made with asphalt, an asphalt composite, laminated fiberglass, or any other material suitable to protect the roof from the elements. The lower portion 18 of the shingle 14 may be sectioned into three tabs or may be an unseparated material.

FIG. 2B shows the bottom surface 26 of the shingle 14. A roof attachment layer of hook and loop fastening material 28 is affixed to the entire bottom surface 26 of the shingle 14. When the shingle 14 is placed on the roof R, the roof attachment layer 28 affixes onto the foundation layer of hook and loop fastening material 12 that is attached to the roof R. The shingle 14 is therefore releasably mated with the foundation layer 12.

The roof attachment layer of hook and loop fastening material 28 covers the entire bottom surface 26 of the shingle 14, and therefore, when the shingle 14 is laid, provides a greater level of resistance against accidental tearing, inclement weather, and curling than if the bottom surface 26 had only a portion, e.g., the upper portion, covered with the hook and loop fastening material. Covering the entire bottom surface 26 of the shingle 14 with the roof attachment layer of hook and loop fastening material 28 provides a stronger hold against the roof R surface, and permits interlocking the shingles 14.

Figure 3:
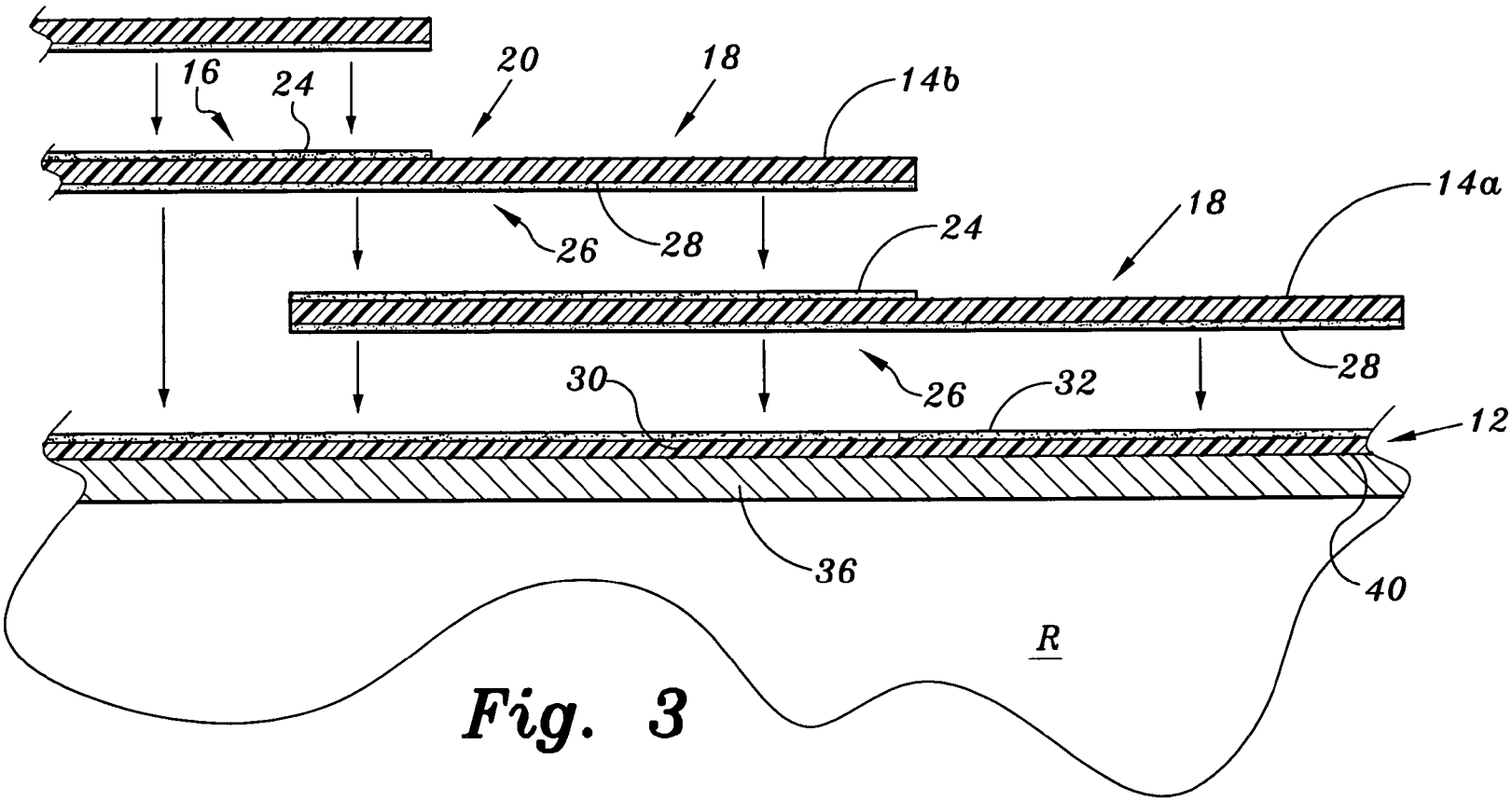
FIG. 3 is a side view of the roofing system in section according to the present invention.

FIG. 3 shows a side view of the reinforced nailless roofing system 10 in section. The foundation layer 12 is a base sheet 30 to which hook and loop fastening material 32 is attached. The bottom surface of the base sheet 30 is coated with an adhesive 40. The foundation layer of hook and loop fastening material 12 is laid onto the surface of the roof R and secured to the roof with the adhesive 40. A backing 36 may be attached to the bottom surface of the foundation layer 12 in order to aid as a water barrier when the foundation layer 12 is laid. In this case, the adhesive 40 is coated onto the backing 36 before the foundation layer 12 and backing 36 are secured to the roof R. The backing 36 is made from a polymer, such as rubber, or any other water-resistant material.

After the foundation layer 12 is set onto the roof R, a first row of shingles 14*a* is laid on the foundation layer 12. The roof attachment layer of hook and loop fastening material 28, attached to the entire bottom surface 26 of the shingle 14, mates with the foundation layer 12 to fasten the shingle 14 to the roof R. A second row of shingles 14*b* is then laid onto the first row of shingles 14*a*. The lower portion 18 of the roof attachment layer of hook and loop fastening material 28 of the second row shingles 14*b* mates with the overlap layer of hook and loop fastening material 24 affixed to the upper portion 16 of the top surface 20 of the first row shingles 14*a*. The upper portion 16 of the roof attachment layer 28 of the second row shingles 14*b* mates with the foundation layer of hook and loop fastening material 12, allowing the second set of shingles 14*b* to be releasably attached both to the roof R and to the first row of shingles 14*a*. Thus, there is greater reinforcement of the shingles 14*a* and 14*b* to the house. Layers of shingles 14 are continually laid, row upon row, until the roof R is entirely covered with the shingles 14.

Figure 4:
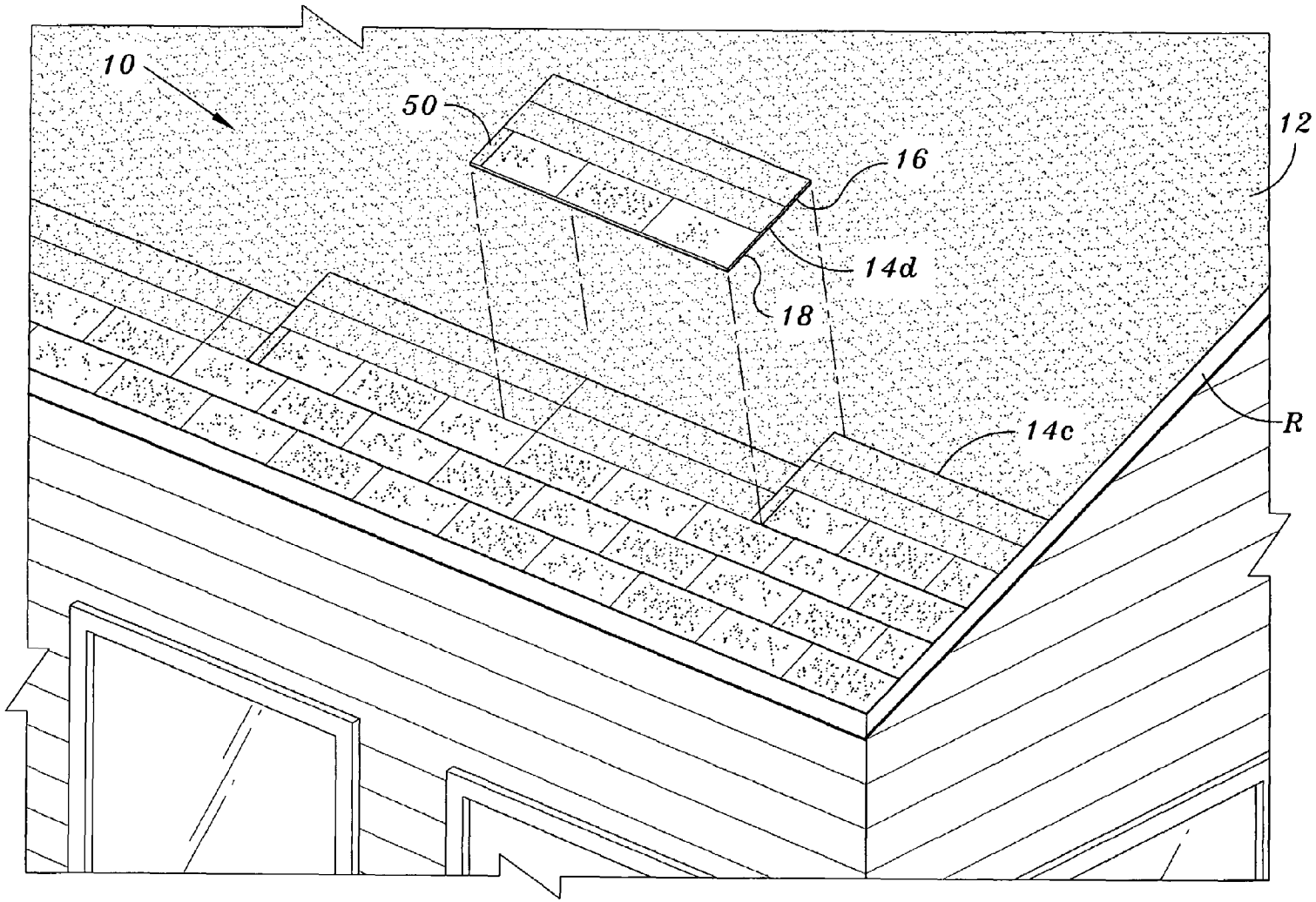
FIG. 4 is an environmental, perspective view of the roofing system according to the present invention with shingles having interlocking hook and loop fastening strips, only a portion of the roof having shingles attached thereto.

Turning now to FIG. 4, the shingles 14 of the nailless roofing system 10 are shown with a lateral strip of hook and loop fastening material 50 affixed to a lateral edge of the lower portion 18 of the top surface 20 of the shingle 14. After a first shingle 14*c* is laid onto the roof R, a second shingle 14*d* is laid adjacent to and overlapping a lateral edge of the first shingle 14*c*. The roof attachment layer 28 of the second shingle 14*d* mates with the lateral strip of hook and loop fastening material 50 of the first shingle 14*c*. Thus, the laterally adjacent shingles 14*c* and 14*d* are releasably held to each other, providing a tighter hold to the roof R. By interlocking laterally adjacent shingles 14 to each other and locking rows of shingles 14 to subsequent rows and additionally to the foundation layer 12, the roofing system 10 provides a high level of resistance against wind, tearing, curling, and the like.

Although one lateral strip is shown, a second lateral strip of hook and loop fastening material 50 may be affixed to the opposite lateral edge of the top surface of the shingle 14.

While hook and loop fasteners have been shown, any other nailless fastener may be used to mate the shingles to the roof and to one another, including opposing magnets or magnetic sheeting, snaps, rivets, porous contacts, nano products, clasps, zippers, suction devices, pins, ionized material, snap-rivets, tape, zip ties, twist ties, organic material, or any other suitable material.

It is to be understood that the present invention is not limited to the embodiment described above, but encompasses any and all embodiments within the scope of the following claims.

We claim:

1. A roofing system, comprising:

a foundation layer of hook and loop fastening material adapted for being affixed to a roof;

a plurality of shingles, each of the shingles having a top surface, a bottom surface, an upper portion and a lower portion;

a roof attachment layer of hook and loop fastening material affixed to the entire bottom surface of each of the shingles, the roof attachment layer releasably mating with the foundation layer; and an overlap layer of hook and loop fastening material affixed to the upper portion of the top surface of each of the shingles, the overlap layer releasably mating with the roof attachment layer of an overlapping one of the shingles;

at least one lateral interlocking strip of hook and loop fastening material affixed to a lateral edge of the lower portion of the top surface of each of the shingles, the roof attachment layer of one of the shingles releasably mating with the interlocking strip of another one of the shingles, whereby laterally adjacent shingles have releasably attachable, overlapping lateral edges;

whereby the shingles are attachable to the foundation layer in rows with the lower portion of one row being releasably attached to the upper portion of an adjacent row of the shingles.

2. The roofing system according to claim 1, wherein at least the lower portion of each of the shingles is made from asphalt.

3. The roofing system according to claim 1, wherein the lower portion of each of the shingles is asphalt composite.

4. The roofing system according to claim 1, wherein the lower portion of each of the shingles is laminated fiberglass.

5. The roofing system according to claim 1, wherein the foundation layer has a bottom surface, the bottom surface being coated with an adhesive adapted for securing the foundation layer to the roof.

6. The roofing system according to claim 1, further comprising a backing attached to a bottom surface of the foundation layer.

7. The roofing system according to claim 6, wherein the backing is made from a polymer.

* * * * *